United States Patent [19]

Jonge Poerink

[11] 3,988,915

[45] Nov. 2, 1976

[54] METHOD AND APPARATUS FOR THE PRODUCTION OF PRESTRESSED COIL SPRINGS

[76] Inventor: Jannes Jonge Poerink, Prins Bernhardlaan, Borne, Netherlands

[22] Filed: Nov. 22, 1974

[21] Appl. No.: 526,430

[52] U.S. Cl. ..... 72/144; 72/140

[51] Int. Cl.[2] ..... B21F 3/04

[58] Field of Search ..... 72/137, 142, 143, 144, 72/135; 140/92.3, 92.4, 92.94

[56] References Cited

UNITED STATES PATENTS

| | | | |
|---|---|---|---|
| 548,000 | 10/1895 | Lloyd | 140/92.3 |
| 1,124,874 | 1/1915 | Diebel | 72/144 |
| 2,446,755 | 8/1948 | Gates | 72/143 |
| 3,101,750 | 8/1963 | Pfaffle | 140/92.3 |

*Primary Examiner*—Lowell A. Larson
*Attorney, Agent, or Firm*—Cushman, Darby & Cushman

[57] ABSTRACT

A method and apparatus for producing prestressed coil springs whereby the wire is fed about a rotating spindle and taken up or drawn in with a predetermined spacing from the front end of the coils and guided to a point ahead of the front end of the coils in the form of an expanded helix. A stop block is movable along the spindle, fixed against rotation and provided with a plurality of wire grooves at different angles of inclination so that the wire passes beneath the already formed coil as it passes through one of the grooves to produce the desired stress.

6 Claims, 2 Drawing Figures

METHOD AND APPARATUS FOR THE PRODUCTION OF PRESTRESSED COIL SPRINGS

Figure 1:
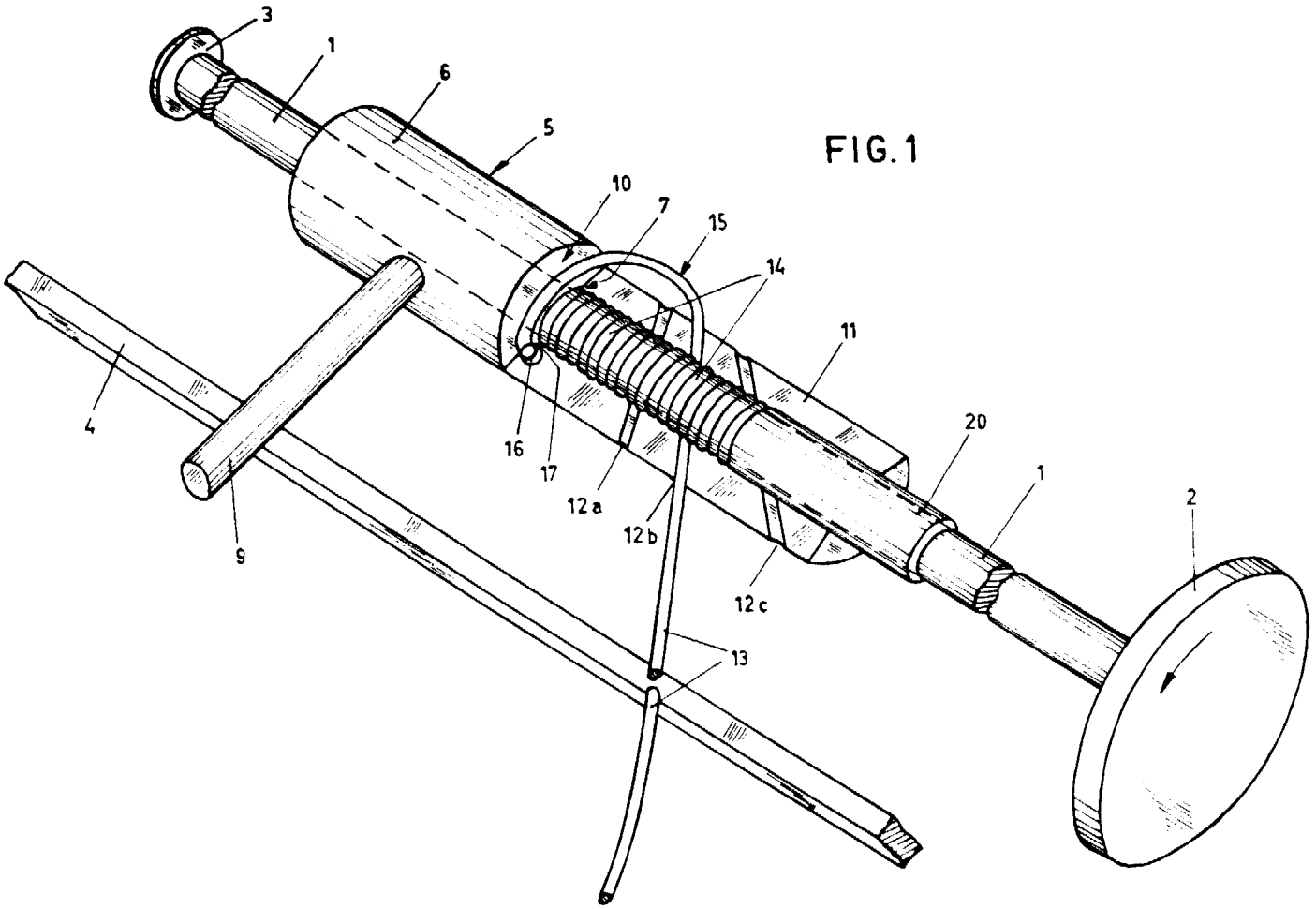

The present invention relates to a method of producing prestressed or pre-loaded coil springs in accordance with the spindle coiling method wherein a wire is fed to a coiling spindle and coiled around such spindle to form spring turns while the front end of the coils advances.

Furthermore, the present invention relates to an apparatus suitable for carrying out such method.

It is known to produce non-prestressed coil springs by coiling a wire around a rotating spindle and thereby guiding the wire in accordance with the progress of the turns. A spring coiling apparatus by means of which such springs can be produced is described in U.S. Pat. No. 2,650,638.

In order to obtain coil springs with a prestress, it is known to twist the wire about its axis prior to the spring coiling step such that the wire is imparted a torsional bias or prestress, and then to coil the wire around the spindle with such prestress.

It is of disadvantage in this method that the prestressing can be performed by means of complicated additional machine elements or by using an already prestressed wire only. Besides, the prestress is difficult to be kept constant because minor differences in the hardness of the wire take a great effect.

Therefore, it is the object of the invention to produce prestressed coil springs in accordance with the spindle coiling method at a particularly favorable price, whereby the apparatus for carrying out the method should be of simple construction and easy to operate, and whereby it should be possible to feed the wire to such apparatus without any pre-treatment. The prestress of the springs should thereby be uniform over the full length of coiling.

These objects are solved by a method of producing coil springs, wherein the wire fed to the coiling spindle is taken up in opposition to the direction of advance of the coils with a given spacing from the front end of the coils and guided to a point ahead of the front end of the coils in the form of an expanded helix. Owing to the fact that the distance of the point of take-up of the wire can be varied, the wire can be imparted higher and smaller prestresses as desired. The helix may consist not only of one turn, but also of one-half or one-quarter of a turn or multiple turns. As the spring material, there may be used e.g. conventional spring wire which is suitable for the production of tension springs, for instance, piano wire having a tensile strength of 2.5 kg/mm$^2$.

The mode of function of the method is based upon the fact that the wire fed in the form of a helix is initially torsionally twisted over an angle of about 180° in its length between the point of take-up and the front end of the coils. The wire is placed ahead of the front end of the coils under such torsion, whereby no compensation or relief of the stress takes place within the individual turns, but the prestress is maintained. Of course, the method may be performed by means of coiling spindles rotating in a right-handed or in a left-handed sense; it is only necessary to take care that the prestress produced in the wires acts in opposition to the tensile stress of the coil spring.

Throw out of the wires placed ahead of the front end of the coils can be safely prevented if the wire is forcefully guided directly upstream of the front end of the coils in opposition to the direction of advance of the coils.

As shown by experience, an adequate prestress is obtained if the fed wire is taken up (drawn in) by about 10 to 20 times the width of the turns ahead of the front end of the coils.

The method can be carried out by means of a spring coiling apparatus which, same as the apparatus according to U.S. Pat. No. 2,650,638, includes a stop block having a lug and being movable longitudinally of the spindle and fixed against rotation, which lug is provided with a least one wire guide groove. In contrast with the conventional apparatus on which springs without prestress only can be coiled, in an apparatus according to the invention the wire guide groove is positioned with an inclination relative to the radial plane of the spindle, and the lug including its guide surface is spaced from the spindle at a distance which corresponds substantially to the diameter of the wire. This construction also represents an essential difference as compared with the prior art because the lug including the guide groove hereby has a greater spacing from the coiling spindle. Due to the advancing front end of the coils, the stop block being movable in longitudinal direction of the spindle is displaced. The stop block including the lug is connected to the system of the turns as the fed wire is passed through the groove and then to a point ahead of the stop or abutment face of the stop block.

A substantial improvement of the apparatus can be seen in an embodiment wherein the lug is provided with a plurality of wire guide grooves of different inclinations. By inserting the wire into different grooves, the length of the helix in which the wire is fed may be varied as desired. Accordingly, various degrees of prestress can be produced.

Finally, it is proposed to provide a guide pin on the lug adjacent the stop or abutment face of the stop block, which pin prevents the turns from jumping out from the front end of the coils and which serves to safely guide the wire from the helix to a point ahead of the front end of the coils.

The method is explained below by referring to the enclosed drawings which show an exemplary embodiment of the apparatus useful for carrying out the method.

Figure 2:
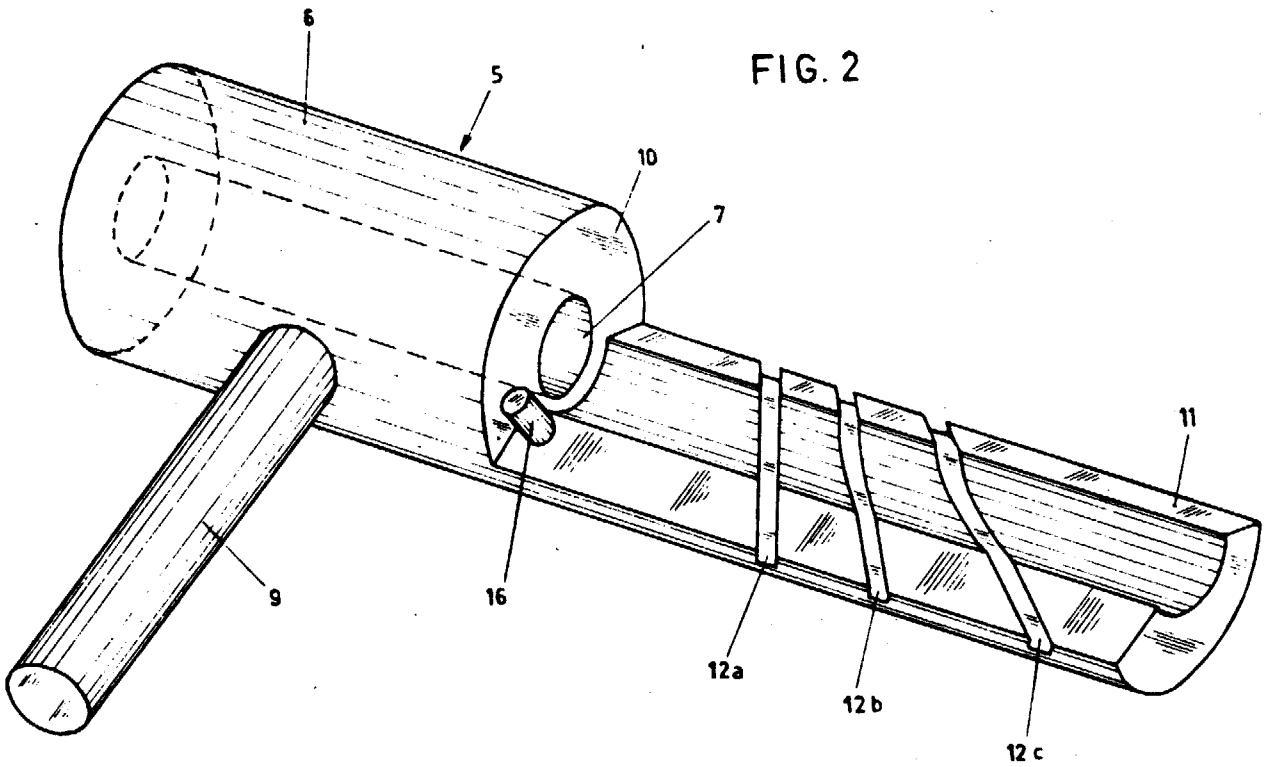

In the drawings:

FIG. 1 is a perspective view of the apparatus in the course of the coiling of a tension coil spring; and FIG. 2 is a detailed view of the stop block including its lug.

FIG. 1 shows a coiling spindle 1 which has one of its ends clamped in the driven chuck 2 of a lathe or coiling machine and which has its opposite end rotatably mounted in a bearing 3. Below and parallel to the coiling spindle, a slide rest 4 extends from the chuck 2 to the bearing 3, which slide rest — as described in greater detail below — is used as an abutment. A stop block 5 is slid onto the coiling spindle 1 which is illustrated with part of its length only. The stop block 5 (FIG. 2) consists of a guide sleeve 6 which has a cylindrical configuration and which has passing therethrough in axial direction a bore 7 of an internal diameter corresponding to the diameter of the coiling spindle 1. In addition, the guide sleeve 6 has a laterally protruding stop or abutment pin 9 which rests upon the slide rest 4 such that said abutment pin 9 is urged against the slide rest with a slight force when the coiling spindle 1 rotates.

One axial surface of the stop block 5 forms the stop face 10. Beginning at the stop face 10, a solid lug 11 is integrally formed with the guide sleeve 6 by milling away a portion of the full cylinder and leaving behind the lower portion of the cylinder along with a recess forming part of the bore 7. Thus, the lug has a somewhat trough-shaped cross-sectional configuration.

Transversely of the lug 11, three grooves 12*a*, 12*b*, 12*c* have been cut at different angles of inclination, which grooves extend from one side of the lug to the other, with the cross-sectional areas of these grooves being identical to each other and corresponding to the wire diameter of the respective wire employed. In addition, a guide pin 16 is mounted on the lug 11 adjacent the stop face 10.

As is apparent from the above description, the stop block 5 is adapted to be moved to and fro on the unconfined coiling spindle 1, whereby rotation of the stop block is arrested by the abutment of the pin 9.

The method of producing the prestressed coil springs is performed as follows: Round steel wire 13, for example with a diameter of 3 millimeters and a tensile strength of 2.5 kg/mm$^2$, is inserted into the groove 12*b* of the stop block. Initially, a large loop is formed behind the groove, and the end of the wire is clamped in the chuck 2.

Thereupon, the wire supply in the loop is coiled into about 20 turns of a non-prestressed coil spring on the coiling spindle (diameter 18 millimeters; direction of rotation: compare FIG. 1). After this step, the wire supply in the loop is exhausted. Approximately 20 turns have been formed in this way, with the front end 17 of these turns abutting against the stop face 10.

The wire is fed to the block 5 in an unstressed and untwisted condition from a commercially available coil of wire, and the wire passes through the groove 12*b* underneath the already formed turns 14 so as to extend in the form of an expanded helix 15 to a position within the gap defined between the guide pin 16 and the stop face 10. In this guiding gap, the wire is positively guided ahead of the front end 17 of the coils. From its exit from the guide groove 12*b* up to the point where it is drawn into the front end 17 of the coils, the wire 13 is imparted a torsion in the direction of the rotary motion of the coiling spindle 1, whereby the stress is prevented from relieving across the free length of the length of wire fed to the apparatus, as the wire is restrained between the groove and the turns. In this way, this stress is transmitted to the formed coil spring, too. As the stress is produced only in the short length between the exit from the guide groove 12*b* and the entry into the front end of the coils, this stress can be dimensioned in a particularly uniform manner.

Since the turning-in angle of the wire through the helix 15 is always constant, the torsional stress which is transmitted to the coil spring as a prestress, can be varied by varying this length of wire. This is rendered possible in that guide grooves (12*a* to 12*c*) are provided under different angles of inclination, into which grooves the wire may be inserted. Most easily, the ultimately produced prestress can be determined empirically. However, if all parameters are known, the values of stress can also be calculated theoretically.

Example: In a coil spring of steel wire having a diameter of 3 millimeters, and with a length of the helix of about 95 millimeters during production, the deflection begins at a force of 21 kp (kilopounds).

Instead of intially coiling the turns without prestress, the method can be performed also by means of a sleeve 20 slid onto the coiling spindle 1. This sleeve 20 is provided with means (for instance, a clamping gap) in which the end of the wire is retained. The outer diameter of the sleeve is equal to the thickness of the turns of the coil spring.

By using the proposed method, it is also possible to produce springs comprising in part prestressed portions and portions without prestress, if the feed end of the wire during the production of the spring is alternatingly introduced directly into the spacing between the stop face 10 and the pin 16 (no prestress) or fed through a helix (prestressed).

After the coil spring has been coiled to the desired length, the wire 13 fed to the apparatus is cut through and the guide block is removed. Then, the spring may be withdrawn from the spindle 1. Subsequently, the additional, customary method steps are performed, such as bending of the eyes and flat grinding of the spring ends.

Reference should be made to the fact that the method described above is adapted to be carried out on lathes and lends itself to the automated production on coiling machines or spring coilers.

The details of the disclosed embodiment may be varied in accordance with the expert's discretion. For example, it is possible to employ in the place of the stop or abutment pin 9, a guide means engaging into the cylindrical surface of the guide sleeve 6. In addition, components of the stop block 5 which are subject to particularly high wear may be hardened or cooled in the automated production.

We claim:

1. A method of producing prestressed coil springs by spindle coiling wherein a wire is fed to a coiling spindle and formed into spring turns around said coiling spindle with the leading end of the coils advancing along the spindle as coil turns are added wherein the fed wire is taken up or drawn in from a point behind the leading end of the coil in opposition to the direction of advance of the coils, with a predetermined spacing from the leading end of the coils and guided to a point ahead of the leading end of the coils in the form of an expanded helix.

2. The method according to claim 1, characterized in that said wire is positively guided in opposition to the direction of advance of the coils, immediately ahead of the front end of the coils.

3. The method according to claim 1, characterized in that the fed wire is taken up or drawn in at a point about 10 to 20 times the width of the coils ahead of the front end of the coils.

4. An apparatus for producing a prestressed coil spring comprising a rotatable spindle, a stop block movable longitudinally of the spindle and fixed against rotation and including a lug having a guide surface and provided with at least one wire guide groove positioned with an inclination relative to the radial plane of said spindle and opposite to the pitch of the coil and the guide surface of said lug being spaced from said spindle by a distance corresponding substantially to the diameter of said wire.

5. The apparatus according to claim 4, wherein said lug is provided with a plurality of wire guide grooves positioned under different angles of inclination.

6. The apparatus according to claim 4 wherein said stop block has a stop face, further including a guide pin disposed on said lug adjacent the stop face of said stop block for guiding said wire into position at the leading end of said coil.

* * * * *